US006840491B2

(12) United States Patent
Swinimer

(10) Patent No.: US 6,840,491 B2
(45) Date of Patent: Jan. 11, 2005

(54) FOOTING FORM

(75) Inventor: Kirk Swinimer, Chester Basin (CA)

(73) Assignee: F & S Manufacturing Inc., Nova Scotia (CA)

( * ) Notice: Subject to any disclaimer, the term of this patent is extended or adjusted under 35 U.S.C. 154(b) by 0 days.

(21) Appl. No.: 10/316,814

(22) Filed: Dec. 11, 2002

(65) Prior Publication Data

US 2004/0111991 A1 Jun. 17, 2004

(51) Int. Cl.[7] ..... E04G 13/02
(52) U.S. Cl. ..... 249/51; 249/48
(58) Field of Search ..... 249/13, 18, 48, 249/51; 52/292, 294, 295, 296, 297, 298

(56) References Cited

U.S. PATENT DOCUMENTS 4,673,157 A * 6/1987 Wells ..... 249/13
5,271,203 A 12/1993 Nagle
5,785,459 A * 7/1998 Swinimer ..... 405/237
5,800,727 A * 9/1998 Croghan ..... 249/51
6,543,742 B2 * 4/2003 Wells ..... 249/51

* cited by examiner

*Primary Examiner*—Michael Safavi
(74) *Attorney, Agent, or Firm*—Fulbright & Jaworski L.L.P.

(57) ABSTRACT

A prefabricated concrete form for the pouring of a footing for a structural pillar is disclosed. The form is preferably constructed from a thermoplastic such as a high density polyethylene or ABS and is molded as a single disposable unit. The form is bell-shaped and has dimensions which render it useful in industrial size applications with large footprints. The dimensioning of the form also reduces the amount of material used for the manufacture of the form, allows the form to be backfilled without cave-in and to reliably support a tubular form for the pillar without an additional bracing or supporting structure. The form is in particular a low profile form wherein the sidewall is inclined at an angle below 45° relative to the bottom edge. A top flange of the form is preferably adapted to accommodate two or more different diameters of the tubular form for the structural pillar. The sidewall may include integral ribs which open inwardly to facilitate evacuation of air as the form is filled and to lend rigidity to the sidewall. The sidewall may further include vent openings for the escape of air which is possibly temporarily entrapped during filling of the form. The advantage is an inexpensive form which does not have an excessive height despite large footprints, fills reliably and supports a tubular form for a pillar without the need for cross-pieces, even at sidewall angles below 45°.

15 Claims, 3 Drawing Sheets

FOOTING FORM

FIELD OF THE INVENTION

This invention relates to concrete forms for materials such as concrete, polymer concrete or the like and, in particular, to forms for molding footings for structural pillars used in the construction industry.

BACKGROUND OF THE INVENTION

The use of structural pillars made from a concrete material is well known and widely practiced in the construction industry. Such pillars are typically poured into a tubular pillar form made of spirally wrapped paper, although other prefabricated pillar forms are well known and commonly used for this purpose. According to most building codes, structural pillars must be supported by a footing located below the level of maximum frost penetration and usually set on a coarse aggregate bed to ensure adequate drainage. The footing which is normally also made of concrete material provides support for the pillar and its load. Traditionally, wooden footing forms built on site were used. More recently, prefabricated forms have been introduced, which overcome the problems encountered with wooden forms, such as the need for at least one cross-piece for supporting the tubular pillar form, the labour intensive and time consuming assembly and disassembly of the wooden forms, improper filling when concrete is fed through the top of the tubular form, and the need to wait until the footing is set before backfilling.

Various types of prefabricated footing forms exist, most of which are somewhat tapered towards the top where the pillar form is adjoined. Bell-shaped (Joubert, U.S. Pat. No. 4,830,543), and conical (Jackson, U.S. Pat. No. 3,108,403; Miller U.S. Pat. No. 1,296,995; Gebelius, U.S. Pat. No. 4,648,220) or frusto-conical (wells, U.S. Pat. No. 4,673,157; Nagle, U.S. Pat. No. 5,271,203) forms are known, with the latter being most common. A conical shape facilitates proper filling of the form with concrete material, makes the form stable and able to support the pillar form, and sometimes even allows for backfilling prior to pouring of the concrete material. However, tapered prefabricated forms have certain structural limits. Swinimer (U.S. Pat. No. 5,785,459) discloses that in order to achieve complete filling of a conical form without vibrating the concrete material, the pitch of the sidewall must be between about 45° and about 65°. Such a sidewall angle is impractical for industrial size applications with large footprint (bottom diameter), for example above 30 inch diameter, since it will lead to an impractically high form and high material cost. The higher the footing, the deeper it must be buried to remain below frost level. Moreover, the transition region between the footing and the pillar, which is a peak stress point of the pillar/footing structure should be located as far below grade as possible to reduce the lateral load at this transition region. Thus, since the vertical location of this transition region is governed by the height of the footing form, forms of large footprint and a sidewall angle of 45° or above are impractical and uneconomical due to high installation and/or excavation cost. Consequently, a more economical and practical prefabricated form is desired.

SUMMARY OF THE INVENTION

It is an object of the invention to provide a prefabricated form for the molding of a concrete footing for a structural pillar, which form overcomes the above mentioned disadvantages.

It is another object of the present invention to provide a prefabricated form for molding a pillar footing of a concrete structural material, which form is shaped to ensure complete filling with the concrete material without entrapped air pockets, while preventing excessive height of the form at large footprints.

It is still another object of the invention to provide a prefabricated form for molding a pillar footing of a concrete structural material, which form is shaped to prevent cave-in of the form upon backfilling prior to filling of the form with the concrete material.

It is yet a further object of the invention to provide a prefabricated pillar form for forming a footing of a concrete structural material which is adapted to accommodate a plurality of diameters of tubular pillar forms.

These objects are now achieved in a prefabricated footing form in accordance with the invention by controlling the dimensions of the form of substantially tapered shape according to strict structural relationships in order to reduce the amount of material needed for manufacture of the form, to ensure proper filling of the form with concrete material, to maintain the height of the form within practical limits, and to prevent cave-in upon backfilling of the form prior to pouring of the concrete material.

In accordance with the invention, a preferred footing form for molding a footing of concrete material at a bottom end of a concrete column, includes

- a substantially tapered rigid hollow body having a circular top end of a first diameter $D_T$, a bottom end of a larger, second diameter $D_B$, the bottom end defining a base plane and being concentrically, vertically spaced from the top end by a height H, and an integral side wall extending between the top and bottom ends, at least a portion of the sidewall being inclined at a sidewall angle below 45° with respect to the base plane, the sidewall having a length S parallel in axial direction of the footing form;
- a circular top flange at the top end for fittingly supporting a prefabricated tubular column form, and a bottom flange at the bottom end for supporting the footing form on a suitably prepared substrate;
- whereby the dimensions of $D_T$, $D_B$, H and S are selected such that $S \leqq 2.4$ h for reducing the amount of material used to manufacture the footing form, $S \geqq 0.55\Delta D$, with $\Delta D = D_B - D_T$ for preventing cave-in of the form upon exterior backfilling prior to molding of the footing, $D_B \geqq 1.8D_T$ for lateral stability of the footing form, $\frac{1}{2}\Delta D \geqq H \geqq \frac{1}{4}\Delta D$ for $D_B \geqq 24$ inches for preventing excessive footing form heights, and $D_T \geqq \frac{1}{2}D_B - H$ for ensuring proper filling of the footing form with a concrete mixture of about 3000 psi to 4000 psi.

The invention therefore provides a prefabricated form for molding a footing of a concrete structural material at a bottom end of a tubular form for a pillar. The form is preferably molded from a thermoplastic resin such as high density polyethylene or ABS, although any other rigid, water resistant material with adequate strength is also suitable. The form is molded as a unit and is tapered in profile. It includes a bottom end with a radial flange and a top end having a top flange that is sized to frictionally engage a tubular form of a specific diameter. The flange on the top end may be adapted to engage the tubular pillar form either internally or externally, but preferably it is adapted to engage the form internally. The top flange is preferably constructed for connection of tubular forms of different diameters.

Preferably, the prefabricated footing form can be manufactured in a range of sizes each adapted to support a number of different diameter tubular forms by way of the top flange.

It is a principal advantage of the prefabricated footing form in accordance with the invention that it has a relatively small height even for large footprints, while still permitting backfilling before the concrete is poured, preventing the hazard of open trenches.

BRIEF DESCRIPTION OF THE DRAWINGS

The invention will now be described by way of example only and with reference to the following drawings, wherein.

DETAILED DESCRIPTION OF THE PREFERRED EMBODIMENT

Despite the structural limitations taught in the prior art, it has now been surprisingly found that a form having a sidewall angle below 45° will reliably fill with a concrete mixture of at most about 3000 psi, as long as other structural limitations of the form follow certain strict relationships. Through extensive research, the applicant has developed certain structural relationships which, if strictly followed, allow the manufacture of prefabricated forms that will still reliably fill with a concrete mixture of up to 4500 psi, despite a sidewall angle below 45° and even as low as about 30°, and without vibration of the concrete. However, if these structural limitations as developed in accordance with the invention are not followed, the form may not fill properly, or even more disastrous results may occur, such as cave-in of the form.

Figure 1:
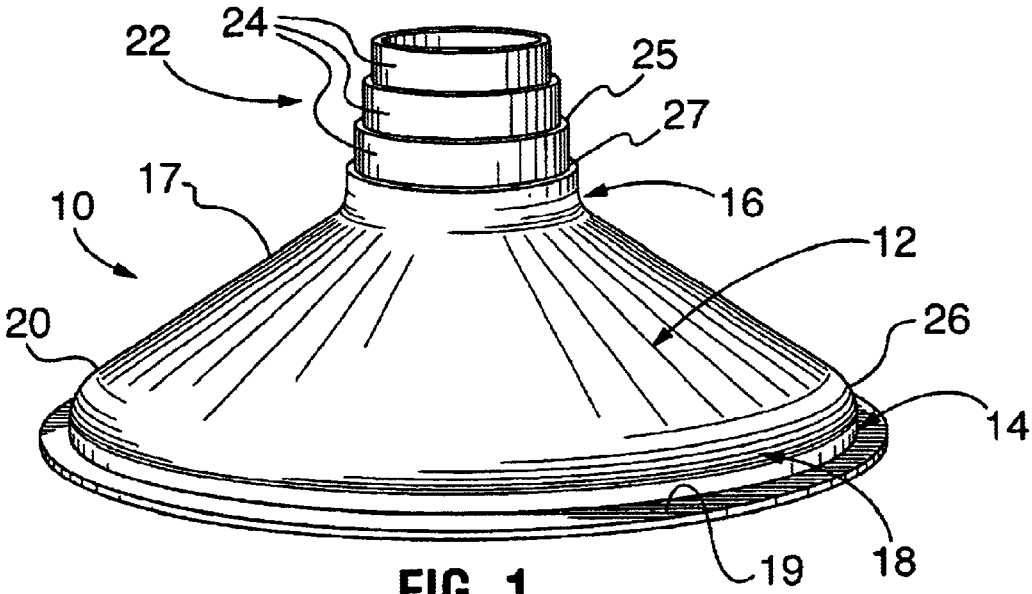
FIG. 1 is a perspective view of a first embodiment of the prefabricated form in accordance with the invention.
Figure 5:
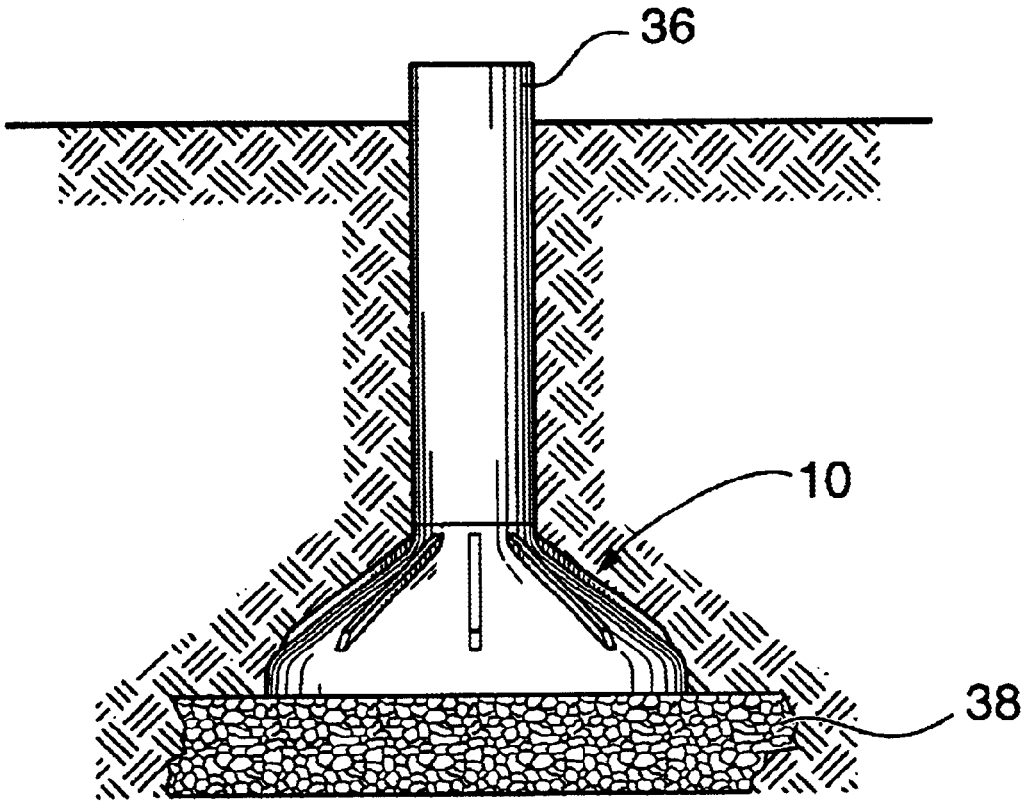
FIG. 5 is an elevational view of the form shown in FIG. 2 in situ ready to be filled with concrete material.

FIG. 1 shows a perspective view of a first embodiment of a prefabricated footing form 10 in accordance with the invention. The prefabricated form 10 includes a substantially tapered right hollow body 12 having a circular top end 16, of a first diameter $D_T$ and a bottom end 14 of a second diameter $D_B$ larger than the first diameter, the top and bottom ends 16, 14 being concentrically aligned along a vertical axis of the body 12. An integral sidewall 17 extends between the top and bottom ends 16, 14, which is preferably inwardly inclined at an angle of about 30° to about 45° to facilitate the evacuation of air when the form is filled with a concrete material. Integral with a bottom edge 20 of the side wall 17 is a bottom flange 18 which includes a substantially axially oriented portion 26 and a radial portion 19. The substantially axially-oriented portion 26 extends upwardly from the radial portion 19 for about 3" to 8" and allows for the production of forms 10 of different overall height. Changes in height of the axially oriented portion can also be used to control the thickness of the base of the footing, at its maximum diameter. Integral with the top end 16 is an axial top flange 22. The top flange 22 preferably includes a plurality of inwardly stepped connectors 24 for engagement with a tubular column form. The connectors 24 are preferably sized to frictionally engage the inner surface of the column form when the tubular form is forced down over one of the connectors 24, as will be described below with reference to FIG. 5. This is achieved by the diameter of each connector increasing from a diameter at the top edge 25 which is slightly smaller than the inner diameter of the column form to a diameter at the bottom end 27 of the connector which is slightly larger than the diameter of the column form. In this way, the column form jams on the connector as it is forced downward thereon. The wall of the connector 24 is preferably inclined from vertical at an angle of up to 5°. At the top end 16 of the footing form 10, the sidewall 17 is preferably somewhat curved to smoothly merge with the top flange 22. This provides a finished pillar and footing combination cast with a prefabricated form in accordance with the invention in connection with a tubular form as shown in FIG. 5 with an additional structural advantage. Due to the smooth curvature at the point of juncture between the finished footing and the pillar, the stress point usually present at this juncture with conventional forming methods caused by the sharp angle between the pillar wall and the footing top surface is avoided. As a result, the danger of cracking of the finished column at this juncture upon movement of the surrounding soil is substantially reduced. The dimensions of the footing form 10 are carefully chosen to ensure proper filling of the form with concrete without the need for vibrating the concrete. In this respect, the inventor surprisingly discovered that footing forms with sidewall angles below 45° and above 30° will reliably fill if other dimensions of the form, such as sidewall length, top and bottom diameter, and height are controlled within strict limits. Moreover, forms for industrial applications and intended to support large loads require relatively large footprints (bottom diameters) of 32" to 48" or even higher. However, footing forms having a sidewall angle of 45° or above are not practical for such applications, since they would have an excessive overall height. Since the footing according to most building codes must be placed below maximum frost depth, excessively high footing forms would result in uneconomical installation and excavation cost. Excessively high forms also require a lot of material to manufacture and fill and, thus, are costly. To overcome these problems and to ensure proper filling, the inventor has determined through extensive experimentation that the following structural limitations will lead to the desired footing form suitable for industrial applications. The sidewall length must be at most 2.4 times the height of the form to minimize the amount of material required for manufacture of the form. The length of the side wall must be at most 0.55 times the difference in diameter between the top and bottom diameters to prevent footing form cave-in upon backfilling prior to filling the form with concrete. For lateral stability of the form, the bottom diameter 14 must be at least 1.8 times the top diameter 16. The height of the footing must be controlled to be in the range of ½ to ¼ of the difference in diameter between the top and bottom diameters, to prevent excessive footing form heights. It has been discovered by the inventor that even if the sidewall is inclined at an angle lower than the slope angle of the concrete used for filling of the form, complete filling of the form without air entrapment can be achieved by enlarging the top diameter sufficiently, and using an accordingly large column form, so that the weight of the concrete in the column form will force the concrete into the most remote corners of the footing form and force out air through the enlarged to diameter and column form. Thus, the relationship between the top and bottom diameters at the top and bottom ends 16, 14 respectively must be controlled to ensure proper filling of the form. In particular, the top diameter must be at least as large as the height of the footing less half the bottom diameter.

Testing of forms with different dimensional and structural limitations was carried out in accordance with CCMC's Technical Guide for Bell Shape Foundation Form, Master Format Section:03315, for below grade applications. Cardboard column forming tubes of appropriate diameter, commercially available under the trademark SONOTUBE, were attached to the footing forms tested. The cardboard tubes were fastened to the appropriate top flange of the footing form with 1 inch wood screws. The footing forms were placed in a 54 inch deep trench onto undisturbed soil. Backfilling with soil was then carried out in even lifts of 6 inch to 18 inch. The soil around the forms was tamped using a mechanical tamper after each lift. The concrete was subsequently poured directly into the form through the cardboard construction tube from a concrete truck and in lifts of about 24 inches, until the construction tube was completely filled. The concrete was rodded about 12 times after each lift. The concrete used was specified to have a compressive strength of 3500 psi and was a mixture of ¾ inch crushed stone aggregate, standard sand, and type 10 Portland cement. The concrete had a slump of 3. After a setting time of two weeks, the forms were excavated and removed from the ground for evaluation. Footing forms constructed to the strict structural limitations according to the present invention were found to have withstood backfilling without cave-in or deformation and to have filled completely with concrete. Even for very large diameters such as 48 inches and low sidewall lengths resulting in sidewall angles of as low as 30°, the concrete flowed into the corners with no voids or honeycombing. It was also surprisingly discovered that the anchor flange 40 (see FIGS. 4 and 5) which will be discussed in more detail below not only anchors the form against lateral movement on the supporting surface during backfilling, but provides additional rigidity and strength to the form. The anchor flange when forced into the supporting medium maintains the geometric shape of the form and prevents deformations of the form at the bottom end, which would severely decrease the structural strength of the form. Especially for low sidewall angles (25 to 40°), maintaining the shape of the bottom flange resulted in a surprising structural strength increase compared to forms without anchor flange. The strength increase was significant enough to allow not only backfilling of the form before pouring of the footing, but even compacting of the backfill around the form. This provides an important additional advantage, since compacting of the backfill after setting of the footing and column is avoided. Moreover, if the backfill is not compacted, the soil around the column will gradually settle and sag, requiring the contractor to return to the job site months after completion of the footing to complete the backfill. This problem is also overcome with a form which allows backfilling prior to pouring of the footing.

An exemplary and non-exhaustive listing of footing forms in accordance with the invention and their structural parameters are given in the following Table 1. All measurements are in inches.

TABLE 1

| Ex. | $D_T$ | $D_B$ | S | H | ΔD |
|---|---|---|---|---|---|
| 1 | 18 | 36 | 10.5 | 5.5 | 18 |
| 2 | 16 | 36 | 11.7 | 6.0 | 20 |
| 3 | 14 | 36 | 12.8 | 6.5 | 22 |
| 4 | 12 | 36 | 13.9 | 7 | 24 |
| 5 | 18 | 48 | 17.5 | 9 | 30 |
| 6 | 20 | 48 | 16.4 | 8.5 | 28 |
| 7 | 22 | 48 | 15.3 | 8 | 26 |
| 8 | 24 | 48 | 14.1 | 7.5 | 24 |

Figure 2:
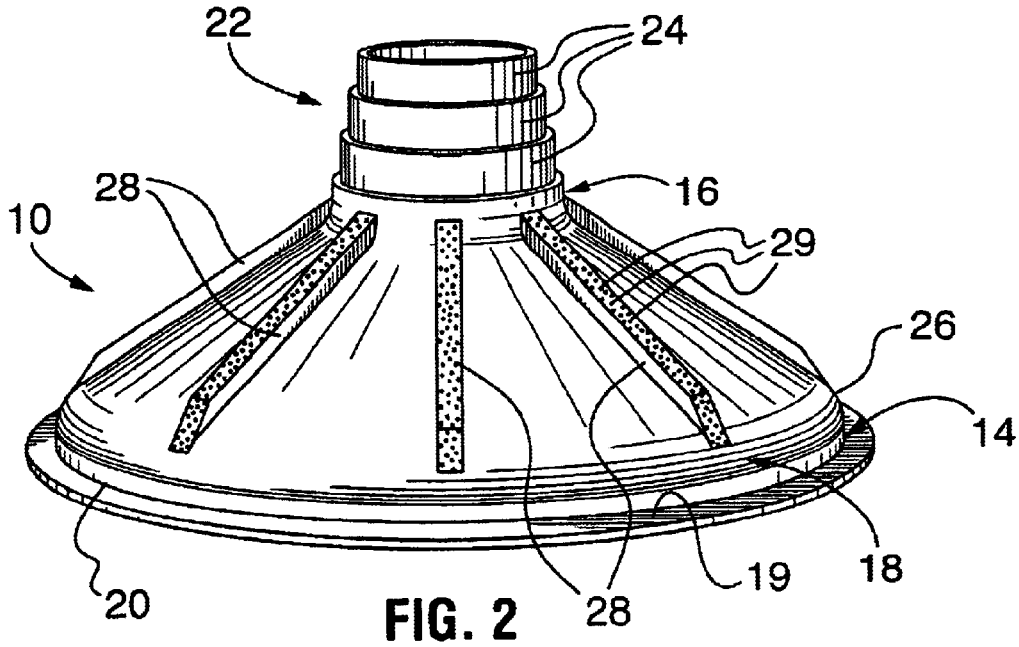
FIG. 2 is a perspective view of another embodiment of the prefabricated form in accordance with the invention.

FIG. 2 shows a perspective view of another embodiment footing form of the invention wherein the sidewall 12 includes a plurality of reinforcing ribs 28. The reinforcing ribs 28 are integrally molded with the sidewall and open inwardly. They preferably extend from the axially-oriented portion 26 to a base of the axial top flange 22. In the preferred embodiment of the invention, the reinforcing ribs 28 are straight and equally spaced apart. They serve to reinforce the sidewall so that it is self supporting in the event that earth is backfilled around the prefabricated form 10 before the form is filled with a settable material such as concrete. The reinforcing ribs 28 also provide channels which further facilitate the evacuation of air as the form is filled with concrete from the top as will be explained below with reference to FIG. 5. Moreover, the reinforcing ribs 28 are preferably provided with a multiplicity of small perforations 29 which are sufficiently small to prevent concrete or cement slurry leakage while permitting air to pass. These perforations 29 or air holes further help in evacuating entrapped air from the form 10 during filling. It should be noted that the reinforcing ribs 28 are not essential to ensure that air is evacuated from the prefabricated form 10. The form 10 with or without reinforcing ribs 28 fills reliably without the entrapment of air and without the need for vibrating the concrete fill when it is filled from the top through the tubular form for the structural pillar. Moreover, the air holes 29 while not absolutely necessary for proper filling of the form, in most cases provide for a faster filling of the form.

Figure 3:
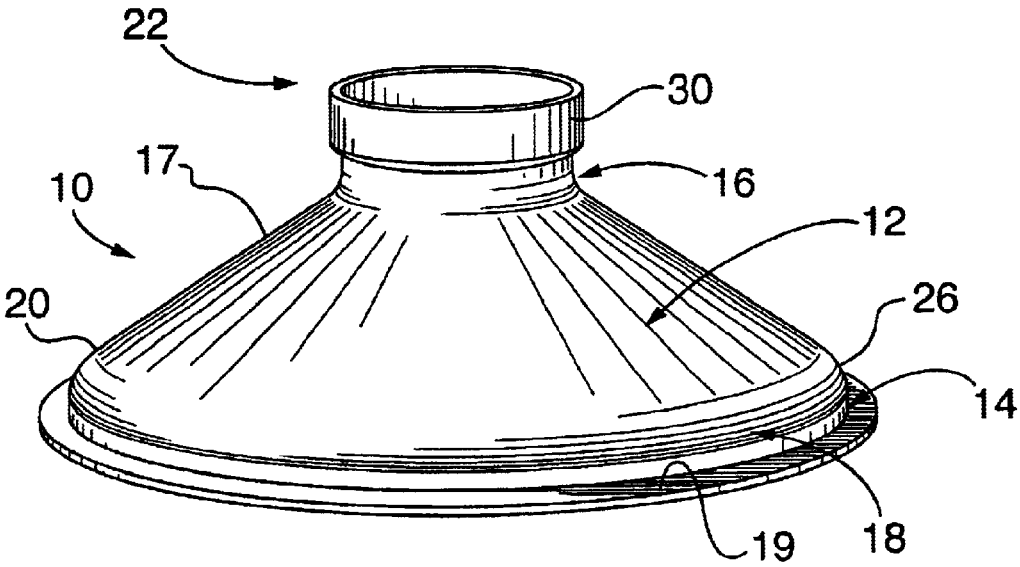
FIG. 3 is a perspective view of yet another embodiment of the prefabricated form in accordance with the invention.

FIG. 3 is a perspective view of yet another embodiment of the prefabricated form in accordance with the invention, including a modified alternate top flange 30 adapted to internally receive a tubular form for a structural pillar.

Figure 4:
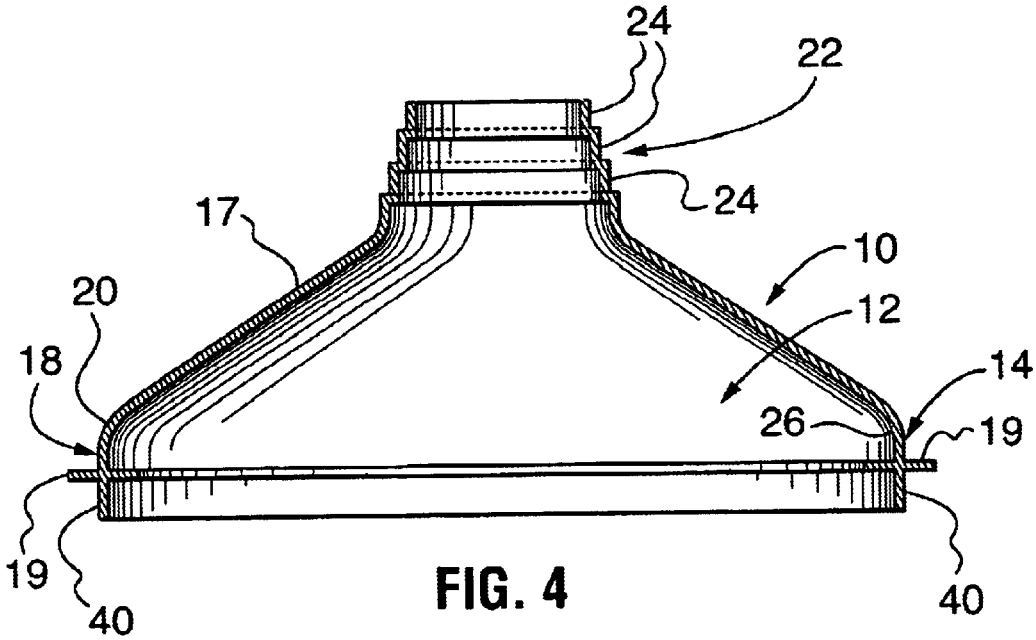
FIG. 4 is a partial cross-sectional view of the embodiment shown in FIG. 1.

FIG. 4 is a cross-sectional view of the embodiment of the footing form shown in FIG. 1. The radial flange portion 19 of bottom flange 18 may extend radially outwardly or inwardly, or both outwardly and inwardly as shown in the drawing. If the radial flange portion 19 extends inwardly, it tends to prevent the form 10 from floating up when it is filled, in the event that earth is not backfilled around the prefabricated form 10 before it is filled with a settable material such as concrete. It should be noted, however, that the prefabricated form 10 has much less tendency to float up when filled with concrete than wooden forms built in situ. Bottom flange 18 preferably includes not only the radial flange portion 19 but also an axial anchor flange 40 which projects downwardly in a direction parallel to the axis of the form 10. The anchor flange 40 may be a continuous cylindrical lip or may be in the form of multiple sections or spikes, which project downwardly. The anchor flange 40 is used for stabilizing the form 10 and especially for maintaining the shape of the bottom end 14 upon backfilling. A continuous lip is especially practical for softer soils or supporting media, while multiple lip portions or spikes are preferred for coarse aggregate and the like.

As described above, the top flange 22 preferably includes a plurality of connectors 24 which are adapted for the connection with different sizes of tubular forms for structural columns. Tubular forms are sold in a range of diameters and this construction of the axial top flange 22 increases the versatility of the prefabricated form 10. It should also be noted that the sidewall of each connector 24 is tilted slightly inwardly from an axial orientation.

FIG. 5 is an elevational view of the form shown in FIG. 2 in situ ready to be filled with a concrete material such as wet concrete. As explained above, a tubular form 36 commonly sold under the trade-mark SONO TUBE is forced over a connector 24 (see FIG. 1 or 2) or into a connector 30 (see FIG. 3) of a prefabricated form 10 in accordance with the invention. Footing form 10 illustrated in FIG. 5 includes reinforcing ribs 28. Normally, structural pillars are set on an aggregate bed 38 which is positioned in a trench below the maximum frost penetration for the respective geographical region of the installation site. If the tubular form 36 is not mounted to the uppermost connector 24, any connectors 24 located above the one actually used may be cut off using a hand saw or the like before the tubular form 36 is seated. This ensures that the structural column is not weakened by the presence of a restriction caused by the unused connectors. The tubular form 36 is preferably fastened at multiple locations to the connector 24, preferably with screws. This results in a more reliable connection, but at the same time makes the top opening of the form 10 more rigid, which means it will more reliably maintain its circular shape. After the tubular form 36 is fitted to the prefabricated form 10 and the latter is located in a proper position on the aggregate bed 38, the stabilizing anchor flange 40 is forced into the aggregate or soil 39 on which the form 10 is supported, until the radial lip 19 of the bottom flange 18 comes to rest against the aggregate or soil 39. This stabilizes the form 10 not only against lateral movement during backfilling, but also stabilizes the shape of the bottom flange 18 and thereby the shape of the form as a whole, as discussed above. The radial flange portion 19 is preferably constructed sufficiently strong to permit forcing of the axial flange portion 40 into the supporting surface by stepping onto the radial flange portion 19. Subsequently, the trench may be backfilled with earth in order to ensure that the form remains in its location while the concrete material such as concrete is poured into the form. The backfilling not only further stabilizes the form in its position, it also permits better access to a top end of tubular form 36 and eliminates the potential hazard of working around open trenches, etc. After the form is in position, whether backfilled or not, reinforcing steel may be inserted into the tubular form 36, as required, and a concrete material such as concrete poured through the top of the tubular form 36 until both the prefabricated form 10 and the tubular form 36 are filled as required.

As explained above, the shape of the prefabricated form 10 aids the filling of the footing form to capacity without the entrapment of air. The air is evacuated along the sidewall 12 and up through the tubular form 36 or through the perforations or vent openings 29 as the concrete material is poured in through the top of the tubular form 36. A solid, optimally shaped footing for supporting a structural column is thereby reliably produced with a minimum of expense and effort. The rigid connection of the tubular form 36 to the prefabricated form 10 for the footing not only ensures that work progresses rapidly, it also ensures that each structural pillar is placed with precision. As well, as noted above, the form can be left in the ground and actually protects the footing from moisture, thus minimizing the risk of frost damage. Thus, a significant advance in the art is realized.

Modification to above-described preferred embodiments of the invention may become apparent to those skilled in the art. The scope of the invention is therefore intended to be limited solely by the scope of the appended claims.

What is claimed is:

1. A prefabricated footing form for molding a footing of concrete material at a bottom end of a concrete column, comprising a substantially tapered rigid hollow body having a vertical axis, a circular top end of a first diameter $D_T$, a bottom end of a second diameter $D_B$ larger than the first diameter, the top and bottom ends being concentrically aligned along the vertical axis, the top and bottom ends being vertically spaced apart at a height H, and an integral side wall extending between the top and bottom ends, at least a portion of the sidewall being inclined at a sidewall angle below 45° with respect to the base plane, the sidewall having a length S from the top to the bottom end;

a circular top flange on the side wall for fittingly supporting a prefabricated tubular column form, and a bottom flange for supporting the footing form on a suitably prepared substrate;

whereby the dimensions of $D_T$, $D_B$, H and S are selected such that $S \leqq 2.4$ H for reducing the amount of material used to manufacture the footing form, $S \geqq 0.55\Delta D$, with $\Delta D = D_B - D_T$ for preventing cave-in of the form upon exterior backfilling prior to molding of the footing, $D_B \geqq 1.8 D_T$ for lateral stability of the footing form, $\frac{1}{2}\Delta D \geqq H \geqq \frac{1}{4}\Delta D$ for $D_B \geqq 24$ inches for preventing excessive footing form heights, and $D_T \geqq 0.5\ D_B - H$ for ensuring proper filling of the footing form with a concrete mixture of about 3000 psi to 4000 psi.

2. A prefabricated footing form as defined in claim 1, wherein the sidewall is reinforced by a plurality of integral ribs that extend at least a part of the way between the bottom end and the top end.

3. A prefabricated footing form as defined in claim 2, wherein the sidewall includes an axially-oriented portion that extends upwardly a short distance from the bottom end and the plurality of reinforcing ribs comprise a plurality of equally spaced-apart ribs that extend from a top edge of the axially-oriented portion of the sidewall to a base of the top flange.

4. A prefabricated footing form as defined in claim 3, wherein the reinforcing ribs open inwardly to provide air channels to promote the evacuation of air from the form as the form is being filled with the settable material through the tubular form for the pillar.

5. A prefabricated footing form as defined in claim 1, wherein the bottom flange extends radially outwardly from the bottom edge.

6. A prefabricated footing form as defined in claim 1, wherein the bottom flange extends radially inwardly from the bottom edge.

7. A prefabricated footing form as defined in claim 1, wherein the form is molded from a plastics material.

8. A prefabricated footing form as defined in claim 7, wherein the plastics material is a thermoplastic material.

9. A prefabricated footing form as defined in claim 8, wherein the thermoplastics material is an injection molded high density polyethylene.

10. A prefabricated footing form as defined in claim 8, wherein the thermoplastics material is a vacuum molded ABS.

11. A prefabricated footing form as defined in claim 1, wherein the bottom end includes a flange that extends radially outwardly therefrom in a plane coincident with the bottom edge, and the sidewall includes an axially-oriented portion that extends upwardly a short distance from the bottom edge.

12. A prefabricated footing form as defined in claim 1, wherein the top flange is adapted to accommodate the attachment of at least three different diameters of the tubular form for the pillar.

13. A prefabricated footing form as defined in claim 1, wherein the flange on the bottom end extends both radially inwardly and outwardly form the bottom edge.

14. A prefabricated footing form as defined in claim 1, wherein the bottom end has a diameter of about 12" to about 48".

15. A prefabricated footing form as defined in claim 1, wherein the bottom flange includes an axial flange portion projecting downwardly in the installed condition for preventing lateral movement of the form on a supporting substrate by engaging into the substrate and to stabilize the shape of the bottom end.

* * * * *